United States Patent [19]

Watson

[11] 4,365,445

[45] Dec. 28, 1982

[54] AUTOMATED FASTENER MACHINING SYSTEM

[76] Inventor: John R. Watson, 21418 S. Bloomfield, Apt. 66, Lakewood, Calif. 90715

[21] Appl. No.: 180,354

[22] Filed: Aug. 22, 1980

[51] Int. Cl.[3] ..... B24B 5/18

[52] U.S. Cl. ..... 51/103 WH; 51/215 HM; 51/215 UE; 10/162 A; 221/167; 193/2 R

[58] Field of Search ..... 51/103 WH, 103 TF, 215 R, 51/215 AR, 215 HM, 215 UE, 215 M; 10/155 R, 155 A, 162 A, 169; 193/2 R, 2 B; 198/389, 391, 392, 402, 417; 221/167, 168, 266; 409/269

[56] References Cited

U.S. PATENT DOCUMENTS

| | | | |
|---|---|---|---|
| 1,733,863 | 10/1929 | Casler | 51/215 R X |
| 2,801,499 | 8/1957 | Jones | 51/103 WH |
| 2,911,763 | 11/1959 | Todd et al. | 51/215 UE X |
| 2,954,648 | 10/1960 | Doerr | 51/215 UE X |
| 2,968,201 | 1/1961 | Reed et al. | 51/215 HM X |
| 3,115,964 | 12/1963 | Logan | 198/402 |
| 3,229,804 | 1/1966 | Anderson | 198/389 |
| 3,578,142 | 5/1971 | Burgess | 198/391 X |
| 3,609,917 | 10/1971 | Mattson et al. | 51/103 WH |
| 4,173,211 | 11/1979 | Crawford | 221/266 X |
| 4,206,539 | 6/1980 | Weresch | 198/391 X |

*Primary Examiner*—Stephen G. Kunin
*Assistant Examiner*—Robert P. Olszewski
*Attorney, Agent, or Firm*—I. Michael Bak-Boychuk

[57] ABSTRACT

An automated feed system for advancing small article blanks into a machine tool for precision finishing comprises a feeder-hopper which aligns the blanks in a common orientation. An output guide then directs a row of these blanks towards an indexing cylinder which then dispenses such, one by one, into the machine tool. The dispensing of these blanks out of the indexing cylinder may occur over a curved chute which terminates in an adjustable head stop or, in the alternative, the head stop may be pivotally moved in synchronism with the cylinder.

3 Claims, 6 Drawing Figures

AUTOMATED FASTENER MACHINING SYSTEM

BACKGROUND OF THE INVENTION

1. Field of the Invention

The present invention relates to machine tools and more particularly to an automated grinding system for forming high precision fasteners.

2. Description of the Prior Art

In many industries the use of high precision fasteners arises quite frequently and therefore becomes a substantial cost item in the end product. For example, in the course of assembling an air frame the strength and the fit of a fastener is of critical significance and fasteners made to high precision from hard materials have been extensively used in the past. Materials like titanium, when used for fasteners, present extraordinary problems not conveniently handled by the present-day automated production systems. In most instances hard fasteners or fasteners made from extremely durable materials are best finally shaped by grinding in order to achieve a dimension which closely fits the dimension of the fastener opening. In conventional practice this grinding step is normally given to a machinist who then manually inserts one fastener after the other into the machine. Either because the material structures involved are ofter exceptionally hard and it is desirable to produce the raw blanks as close to the final dimension as possible or because the article is extremely small the machinist does not have the necessary surface through which the fastener may be manipulated into the machine. Accordingly, automated advancing mechanisms are therefore necessary. It is such an automated advancing mechanism that is set out herein.

SUMMARY OF THE INVENTION

Accordingly, it is the general purpose and object of the present invention to provide a grinding system which is automatically fed with fastener blanks for precision shaping thereof.

Other objects of the invention are to provide an automatic advancement of fastener blanks into a machine arrangement.

Yet further objects of the invention are to provide an automatic feed system for advancing articles for precision grinding.

Briefly, these and other objects are accomplished within the present invention by providing a feed hopper of the vibrating kind which includes at its output a gate for aligning fastener blanks in one direction. The gate may be adjustable to accommodate blanks of various sizes and may be placed at the input of an output guide which turns the fastener blanks to an upside-down alignment. The fastener blanks, with the enlarged heads at the bottom, are then directed against an indexing cylinder provided with a plurality of conforming cutouts at the periphery thereof. Thus as the cylinder is advanced in rotation past the output guides one of the fastener blanks therein is picked up. The indexing cylinder, the other end, is aligned to feed a turning chute directing the fasteners between a feed wheel and a grinding wheel. In order to promote the full insertion of the fastener blank an insertion hammer is provided which is articulated by a cam in synchronism with the feed wheel. The feed wheel itself may be of the eccentric type having a small enlarged gap relative the grinding wheel according to the orientation thereof. It is this small gap that dictates the final dimension of the fastener and once this small gap is passed the feed wheel then remains the only surface supporting the end-product. This finished fastener is then dropped by a notch on the feed wheel into a container for collection.

In the foregoing manner high precision fasteners are automatically formed in a grinding operation that will accommodate material selections of extreme hardness.

BRIEF DESCRIPTION OF THE DRAWINGS

FIG. 1 is a perspective illustration of an automatic feed system constructed according to the invention herein;

DESCRIPTION OF THE SPECIFIC EMBODIMENT

Figure 2:
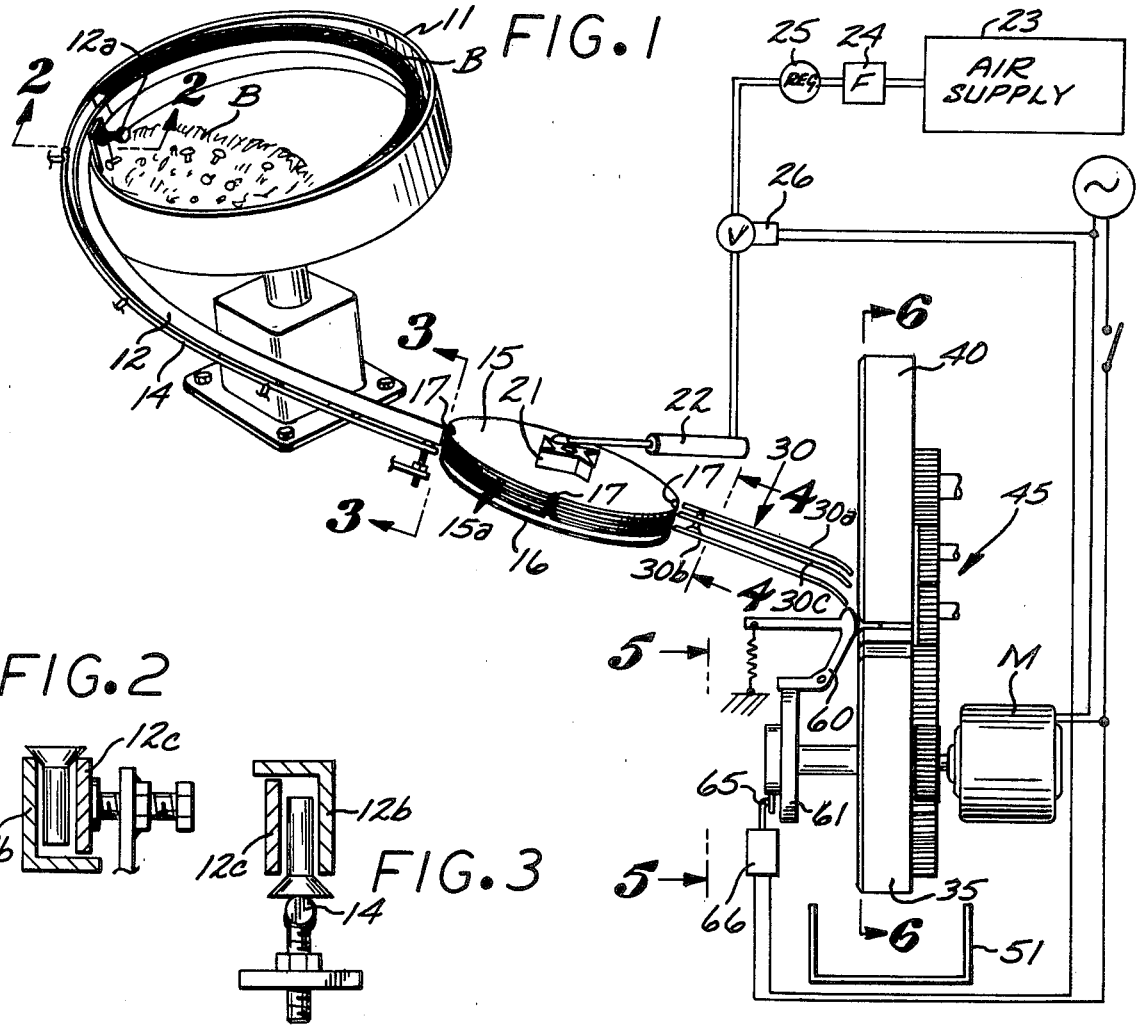
FIG. 2 is a sectional view of a feed guide taken along line 2—2 of FIG. 1.

As shown in FIG. 1 a feed hopper assembly 11 of the vibratory type, advances a plurality of fastener blanks B into a peripheral rank which is then fed into a turning guide 12 which reorients the blanks B into a head down position proximate an indexing cylinder 15. More specifically, hopper 11, in the manner conventionally practiced in the art, includes a peripheral groove into which the randomly dropped fastener blanks B eventually migrate. Once in this groove the fasteners can only take one alignment, i.e. a fastener head up alignment. In this alignment the blanks B are advanced into the guide 12 which may be provided with the necessary adjustment features **12*a* for accommodating fasteners of different size. Furthermore, guide 12 includes a top rail 14 which at the end thereof forms the support point for the fastener blanks as they are advanced against the indexing cylinder. The indexing cylinder 15 may comprise a plurality of circular plates 15*a* placed on top of a base plate 16 of a slightly larger diameter. Plate 16 thus forms the surface on which the head or the enlarged portion of the fastener blank B is placed as the fastener blank exits from the turning guide. In this position the fastener is aligned for pick-up by any plurality of semicircular cut outs 17 formed in the common periphery of the plates 15*a*** and dimensioned to receive the blanks.

Figure 6:
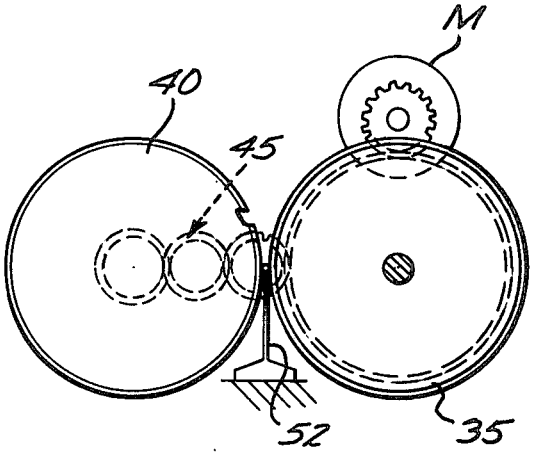
FIG. 6 is a gearing arrangement illustrating one manner of gearing the invention herein, as taken along line 6—6 of FIG. 1.

The indexing cylinder 15 may be advanced by way of a ratchet 21 articulated by an air cylinder 22 operated by an air supply 23 connected across a filter 24 and a regulator 25 in series with a valve 26. As the cylinder 15 is thus advanced, the cut outs 17 and therefore the fastener blank therein pass the receiving end of a turning chute 30 comprising rods **30*a*–30*c* aligned with a rod 30*b* forming a base support and rods 30*a* and 30*c* forming the lateral guides for extracting the fastener B and guiding such into a sideways alignment. In this alignment fastener B falls onto the periphery of a feed wheel 35 which is disposed to rotate adjacent a grinding wheel 40. As shown in FIG. 6, wheels 35 and 40 may be geared in common by way of a train, or other similar gearing arrangement 45 connected to be driven by a sprocket at the output of the motor M. In this gearing arrangement the grinding wheel 40 is set to rotate at a rate substantially faster than the feed wheel 35. Furthermore, feed wheel 35 is aligned slightly eccentric relative the axis of rotation thereof and thus one point along its periphery will be closer than the remaining points. It is this separation that controls tha maximum exterior dimension of the ground fastener and once this point is passed the fastener, in its now finished form, is free to be carried along with the feed wheel to drop out into a collection bin 51. To oppose the inward progression of the fastener B in the course of its grinding as it is engaged by the grinding wheel 40 a blade 52** is extended into the gap between the feed and the grinding wheels acting as a rest and a reference at which the minimal dimension is taken.

In this configuration the insertion of the fastener B in between the feed and grinding wheels may be further promoted by a pivoted hammer 60 spring biased against a cam 61 mounted on the exterior of the feed wheel 35. This hammer assembly 60 includes a curved face aligned to support the head of a fastener B as it passes out of the turning chute 30 and it is the setting of this curved face that controls the depth of insertion. The fastener B as it first drops onto the feed wheel 35 will be carried against the blade 52 to be thereafter followed by the insertion stroke of the hammer assembly 60, should such be necessary. As the high point of the feed wheel 35 passes the edge of blade 52 a trip lever 65 on the exterior of the feed wheel may articulate a switch 66 to open the valve 26 and thus advance the indexing cylinder. In the alternative, rather than a trip lever, a cam 65 may be used on the exterior of cam 61, switch 66 being provided with an end roller for cam following.

Figure 3:
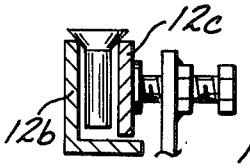
FIG. 3 is an end view of the feed guide shown in FIG. 2 taken along the end section 3—3 of FIG. 1.
Figure 4:
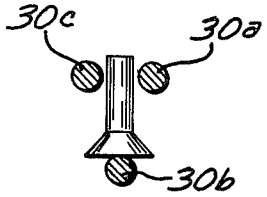
FIG. 4 is a sectional view of a turning chute taken along line 4—4 of FIG. 1.
Figure 5:
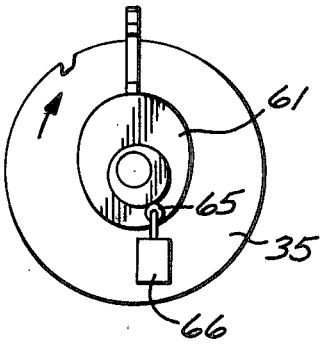
FIG. 5 is a front view of a feed wheel taken along line 5—5 of FIG. 1.

In the foregoing arrangement the alignment of cams 61 and 65 control the sequence of indexing cylinder advancement and the inserting stroke. Thus the fastener blank B may be dropped between the feed and grinding wheels at a point of their maximum separation. Furthermore, as shown in FIGS. 2 and 3 the geometry of the turning guides 12 may be variously adjusted, guide 12 comprising an L-shaped rail **12*b* aligned adjacent an adjustable rail 12*c*. This combination of rails is turned or twisted until the head of the fastener B is directed downwardly where it is supported by the aforementioned rod 14. Again, rod 14 may be adjusted in the alignment thereof relative the rails 12*b* and 12*c* by way of an adjusting screw or similar device. In this manner fasteners of various dimensions can be conveniently accommodated and grind rates adapted for various metal characteristics may be conveniently selected by the selection of gearing between feed wheels 35 and grinding wheels 40**.

Obviously many modifications and changes can be made to the foregoing description without departing from the spirit of the invention. It is therefore intended that the scope of the invention be determined solely on the claims appended hereto.

What is claimed is:

1. Apparatus for advancing fastener blanks into a machine conformed as a centerless grinder having a grinding wheel geared to rotate adjacent a feed wheel, and a head stop mounted between said grinding and feed wheels, comprising:

a vibratory feeder assembly adapted to receive, in random alignment, a plurality of said blanks and rendered operative to align said blanks in a coherent vertical alignment;

a guide connected to said feeder assembly for receiving said blanks in a row and for inverting the alignment thereof;

an indexing cylinder deployed proximate the output of said guide and conformed to receive in succession the end ones of said row of blanks, said cylinder including peripheral recesses conformed to receive said blanks and advancing means, including an air operated piston rendered operative at the completion of operation on said blank by said machine tool, for periodically advancing said cylinder in rotation;

a turning chute mounted along said cylinder and aligned to receive said blanks, in sequence, contain in said recesses, said chute being convolved to align the descent by gravity of said blanks therethrough to a horizontal position; said head stop being mounted on said machine tool and aligned with said turning chute for directing said blanks into said machine tool and for opposing the withdrawal thereof said head stop includes a pivotal mount for articulation thereabout; and said feed wheel includes a first and second cam respectively connected to enable said air operated piston and to articulate said head stop according to the rotation of said feed wheel.

2. Apparatus according to claim 1 wherein:

said cylinder comprises a plurality of circular plates stacked to a height substantially equal to the height of said blank.

3. Apparatus according to claim 2 wherein:

said guide comprises a channeled structure having one side thereof adjustably mounted to accommodate various blank sizes.

* * * * *